United States Patent [19]

Ivory

[11] Patent Number: 4,702,445

[45] Date of Patent: Oct. 27, 1987

[54] SELF ADJUSTING BAG SUPPORT

[76] Inventor: Brian K. Ivory, 815 Sunshine, Youngstown, Ohio 44505

[21] Appl. No.: 14,014

[22] Filed: Feb. 12, 1987

[51] Int. Cl.[4] ..... B65B 67/04

[52] U.S. Cl. ..... 248/100; 248/97

[58] Field of Search ..... 248/97, 99, 100, 101; 141/390, 312, 316; 294/1.1; 383/33

[56] References Cited

U.S. PATENT DOCUMENTS

| | | | |
|---|---|---|---|
| 310,101 | 12/1884 | Wagner | 248/99 X |
| 310,210 | 1/1885 | Liedel | 248/101 X |
| 637,248 | 11/1899 | Hagstrom | 248/101 |
| 1,322,445 | 11/1919 | Hyer | 248/97 |
| 2,100,235 | 11/1937 | Brown | 248/100 X |
| 2,694,541 | 11/1954 | Johnson | 248/100 |
| 2,991,031 | 7/1961 | Sederquist | 141/390 X |
| 4,282,911 | 8/1981 | Sumitomo | 248/100 X |
| 4,312,489 | 1/1982 | Paetzold | 248/97 |
| 4,319,726 | 3/1982 | Andersson | 248/99 X |

*Primary Examiner*—J. Franklin Foss

*Attorney, Agent, or Firm*—Harpman & Harpman

[57] ABSTRACT

A bag support device for expanding and holding a disposable bag in an upright open position. The bag support devices comprises a pair of interlocking support rings engagable on the disposable bag holding the bag in open accessible position.

1 Claim, 4 Drawing Figures

SELF ADJUSTING BAG SUPPORT

BACKGROUND OF THE INVENTION

1. Technical Field:

This invention relates to bag supporting devices that hold a disposable bag or the like in a self-supporting open position.

2. Description of the Prior Art

Prior art devices of this type have relied on a variety of different design configurations to hold open and support bags. See for example U.S. Pats. Nos. 637,248, 310,210 and 2,694,541.

In U.S. Pat. No. 637,248 a bag holder is disclosed having a lower annular arm and an inter-locking pivoted upper arm. A flange extends from the upper arm as a guide member.

In U.S. Pat. No. 310,210, a bag holder is shown having a pair of oppositely disposed rings that are located together over a bag holding the same open.

Finally in U.S. Pat. No. 2,694,541, a collapsible bag support device is disclosed wherein a number of curved, flattened arms are pivotally secured to one another at their ends and a midsections. This pivot configuration allows the arms to be collapsed or expanded to hold different sizes of bags in a scissors-like motion.

SUMMARY OF THE INVENTION

A bag support device that is used to support and hold open a disposable trash bag. The support device locks onto the open end of the bag expanding the same into an open configuration. The bag support device is self-supporting and is adjustable in vertical relation to accommodate variety of sizes of disposable bags available today.

DESCRIPTION OF THE PREFERRED EMBODIMENT

Figure 1:
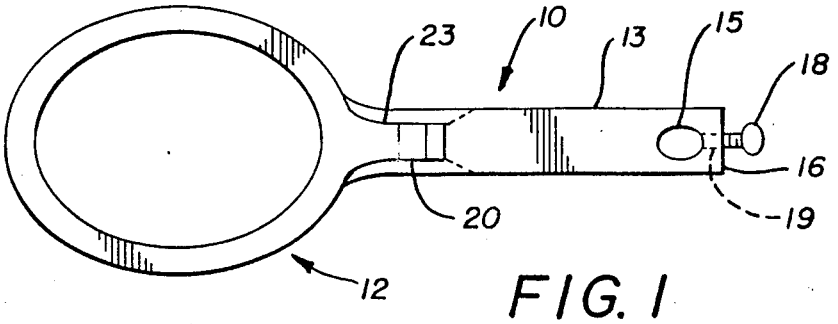
FIG. 1 is a top plan view of the support device.
Figure 2:
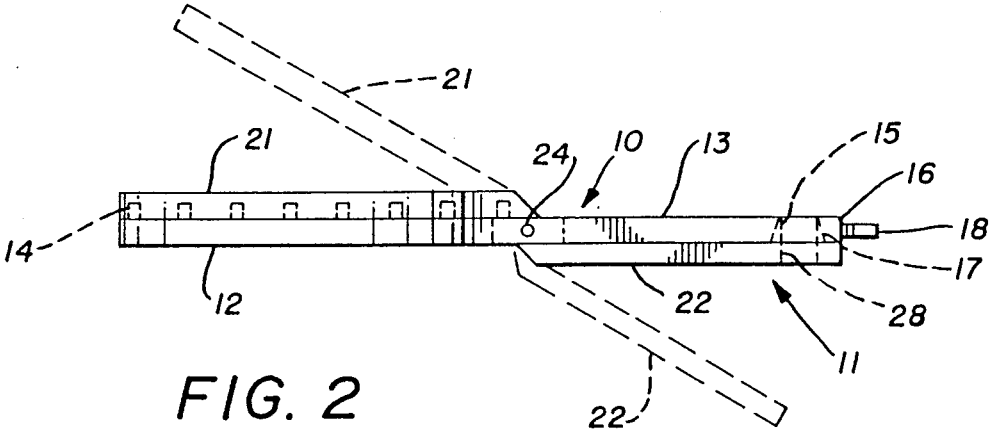
FIG. 2 is a side elevation of the support device seen in FIG. 1.

A bag support device can be seen in FIGS. 1 and 2 of the drawings comprising a pair of inter-engaging frame members 10 and 11. The lower frame member 10 has a ring portion 12 and a handle support portion 13. The ring portion 12 has a plurality of upstanding teeth 14 that are horizontally spaced in relation to one another and extend around the ring portion 12. The handle portion 13 has an ovaloid opening 15 inwardly from its free end 16. A tapered surface 17 shown in broken lines in FIG. 2 of the drawings is formed in the opening 15. A threaded locking bolt 18 is registrably positioned in a longitudinal bore 19 in the free end 16 of the handle portion 13 extending into the opening at 15. A large rectangular slot 20 extends through said frame member 11 midway along its length adjacent the transition between the ring and handle portions. The other frame member 11 has a ring portion 21 and a handle support portion 22 offset in relation to one another on their longitudinal plane.

The offset portion of the frame member 11 is of a reduced transverse dimension at 23 in relation to the remaining handle support 22 as best seen in FIG. 1 of the drawings and extends through the slot 20 with the ring portion 21 overlying the ring portion 12 of the lower frame member 10.

The handle support portion 22 extends under said handle support portion 13 with a pivot pin 24 pivotally securing said frame members 10 and 11 together at the intersection of the same as hereinbefore described.

Figure 3:
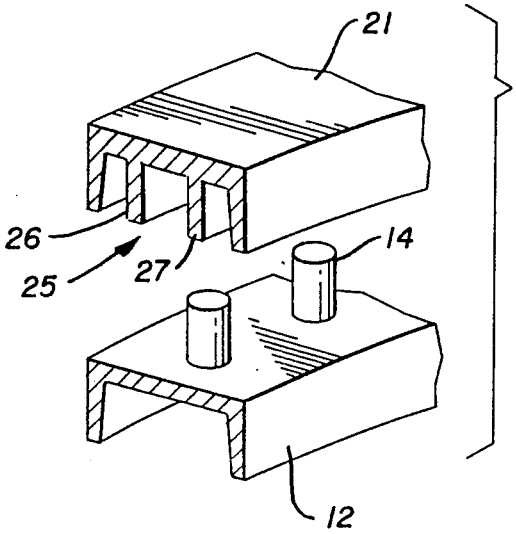
FIG. 3 is an enlarged section of the device broken away that shows the interlocking configuration.

Referring now to FIG. 3 of the drawings, an enlarged portion of the ring portions 12 and 21 can be seen wherein the teeth 14 are aligned to register within a groove 25 formed in the underside of said ring portion 21 by a pair of continuously spaced, annularly depending flanges 26 and 27.

The groove 25 is of an interior width slightly less than that of the outer diameter of said teeth 14.

Figure 4:
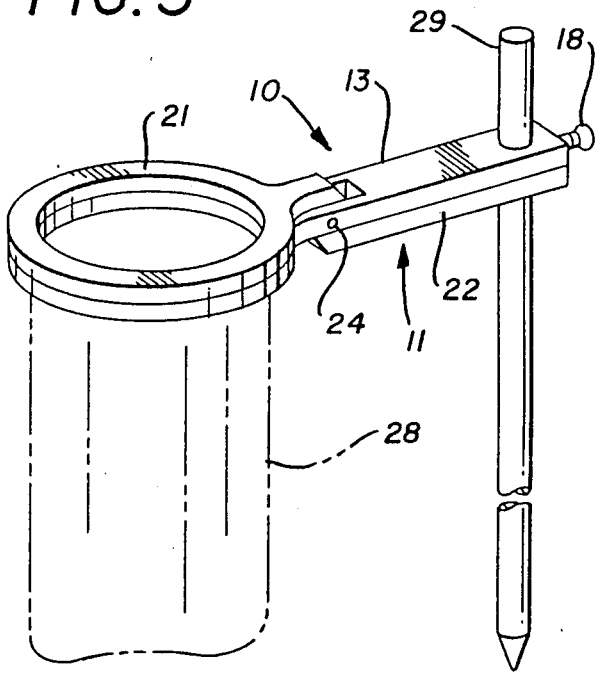
FIG. 4 is a perspective view of the device on a vertical support member.

In FIG. 4 of the drawings, the bag support device is shown having a disposable bag 28 shown in broken lines secured between ring portions 12 and 21 with the bag gripped by the interlocking teeth 14 and registering annular groove 25 as will be well understood by thoese skilled in the art. The frame members 10 and 11 are held together in closed position on the bag by the engagement of the teeth 14 and the groove 25 and by the locking action of the handle support portion 22 which has an upstanding tapered annular flange extending from and positioned around a secondary ovaloid opening at 28 spaced inwardly from the handle support portion's free end in alignment with said opening at 15 as herein before described. The annular flange wedgeably engages the tapered surface 17 locking the handle support portions 13 and 22 together.

Referring now to FIG. 4 of the drawings, a post 29 can be seen passing through the ovaloid openings at 15 and 28 and the threaded locking bolt 18 is advanced to engage the post 29 holding the bag support device by its handle portions thereon.

It will be evident from the above description that bags of different heights and sizes can be accommodated and that the bag support device can be used without the post 29 depending on the use requirement.

It will thus be seen that a new and novel combination of a bag support and holder device has been illustrated and described and it will be apparent to those skilled in the art that various changes and modifications may be made therein without departing from the spirit of the invention and having thus described my invention, what I claim is:

1. A bag supporting device comprising a pair of inter-engaging frame members, each frame member having a ring portion and a elongated handle portion of a length greater than that of said ring portion, a slot in the handle portion of one of said frame members adjacent said ring portion and an area of reduced transverse dimension on the handle portion of said other frame member, wherein said portion of the handle having an area of reduced transverse dimension is angularly offset in relation to the longitudinal axis of its handle portion and is engageable through said slot in the handle portion of one of said frame members, said frame member defined by said portion of the handle having an angularly offset area of reduced transverse dimension, has the remaining handle portion adjacent said angularly offset area parallel to one another, a pivot in said handle portion of said area of reduced transverse dimension of said handle portion, a plurality of spaced teeth extending from one of said ring portions registerably engaging in said annular slot extending completely around said other ring.

* * * * *